US009316214B2

(12) United States Patent
Du

(10) Patent No.: US 9,316,214 B2
(45) Date of Patent: Apr. 19, 2016

(54) BAG IN BOX BEVERAGE PUMP

(76) Inventor: Benjamin R. Du, Newport Coast, CA (US)

( * ) Notice: Subject to any disclaimer, the term of this patent is extended or adjusted under 35 U.S.C. 154(b) by 873 days.

(21) Appl. No.: 13/438,157

(22) Filed: Apr. 3, 2012

(65) Prior Publication Data

US 2013/0259708 A1 Oct. 3, 2013

(51) Int. Cl.

| | |
|---|---|
| ***F04B 43/073*** | (2006.01) |
| ***F04B 9/135*** | (2006.01) |
| ***F04B 9/125*** | (2006.01) |
| ***F04B 43/06*** | (2006.01) |

(52) U.S. Cl.

CPC ..... *F04B 9/135* (2013.01); *F04B 9/125* (2013.01); *F04B 9/1253* (2013.01); *F04B 43/06* (2013.01); *F04B 43/073* (2013.01); *F04B 43/0736* (2013.01)

(58) Field of Classification Search

CPC ..... F04B 43/073; F04B 43/0736; F04B 9/135
USPC ..... 417/392, 393, 395
See application file for complete search history.

(56) References Cited

U.S. PATENT DOCUMENTS

| | | | | |
|---|---|---|---|---|
| 4,467,941 | A | 8/1984 | Du | |
| 4,540,349 | A | 9/1985 | Du | |
| 4,957,220 | A | 9/1990 | Du | |
| 5,083,906 | A | 1/1992 | Du | |
| 5,158,210 | A | 10/1992 | Du | |
| 5,170,912 | A | 12/1992 | Du | |
| 5,188,255 | A | 2/1993 | Du | |
| 5,230,443 | A | 7/1993 | Du | |
| 5,350,083 | A | 9/1994 | Du | |
| 5,361,943 | A | 11/1994 | Du | |
| 5,435,466 | A | 7/1995 | Du | |
| 5,540,556 | A | 7/1996 | Du | |
| 5,613,834 | A | 3/1997 | Du | |
| 5,664,940 | A | 9/1997 | Du | |
| 5,749,709 | A | 5/1998 | Du | |
| 5,772,412 | A * | 6/1998 | Zytynski | 417/393 |
| 5,833,439 | A * | 11/1998 | Du | 417/393 |
| 6,062,427 | A | 5/2000 | Du | |
| 6,099,264 | A | 8/2000 | Du | |
| 6,325,604 | B1 | 12/2001 | Du | |
| 6,343,539 | B1 | 2/2002 | Du | |
| 6,382,934 | B2 * | 5/2002 | Budde | 417/395 |
| 7,013,925 | B1 | 3/2006 | Saveliev et al. | |

(Continued)

OTHER PUBLICATIONS

Florjet Corporation, Flojet 5500 Series CO2 Operated Bag-In-Box Pump, 4 pages.

*Primary Examiner* — Peter J Bertheaud
(74) *Attorney, Agent, or Firm* — Stetina Brunda Garred & Brucker

(57) ABSTRACT

A pump operated with compressed gas is disclosed herein. The pump has two separate cylinders which share a common wall. Pistons are attached to a common shaft that runs through the common wall. The pistons are disposed within each of the cylinders. The pistons divide the cylinders into gas and liquid chambers. The liquid chambers of the cylinder form a liquid system and are in fluid communication with the liquid inlet and outlet. The gas chambers of the cylinders form a gas system and are in communication with gas inlet and outlet. A manifold switching mechanism controls routing of compressed gas to either one of the gas chambers to operate the gas operated pump. The pump may also have an automatic shutoff valve which shuts off operation of the pump when liquid from a liquid source has been depleted.

21 Claims, 15 Drawing Sheets

(56) References Cited

U.S. PATENT DOCUMENTS

| | | | | |
|---|---|---|---|---|
| 7,371,045 | B2 | 5/2008 | Patel et al. | |
| 7,597,204 | B2 | 10/2009 | Jersey et al. | |
| 7,806,664 | B2 | 10/2010 | Patel et al. | |
| 7,815,079 | B2 | 10/2010 | Saveliev et al. | |
| 7,878,766 | B2 | 2/2011 | Meza et al. | |
| 7,980,270 | B2 * | 7/2011 | Bertsch et al. | 137/625.69 |
| 2007/0092385 | A1 * | 4/2007 | Petrie Pe | 417/395 |
| 2009/0014466 | A1 | 1/2009 | Saveliev et al. | |

* cited by examiner

BAG IN BOX BEVERAGE PUMP

CROSS-REFERENCE TO RELATED APPLICATIONS

Not Applicable

STATEMENT RE: FEDERALLY SPONSORED RESEARCH/DEVELOPMENT

Not Applicable

BACKGROUND

The embodiments disclosed herein relate to a compressed gas operated pump for pumping soda syrup from a syrup bag to a soda dispenser.

Prior art compressed gas operated pumps for pumping soda syrup to a soda dispenser exists. For example, U.S. Pat. No. 5,661,940 ('940 patent) discloses one such pump. Unfortunately, the gas driven pump disclosed in the '940 patent is expensive to manufacture. In particular, the piston has flexible barriers which are over molded over the pistons. This process of over molding the flexible barriers over the pistons is expensive. Moreover, the housing of the gas driven pump of the '940 patent has two separate cylinders and a middle chamber which adds to the cost of the gas driven pump.

Accordingly, there is a need in the art for an improved gas driven pump.

BRIEF SUMMARY

The embodiments of a gas driven pump described herein address the needs discussed above, discussed below and those that are known in the art.

The pump has first and second cylinders which house first and second pistons. These cylinders share a common wall which has an aperture. The aperture receives a shaft. The pistons are mounted to the shaft so that the shaft and pistons reciprocate as a unitary structure along a longitudinal axis of the shaft. Each of the pistons in each of the cylinders define a gas chamber as well as a liquid chamber. Each of the pistons may have a flex barrier which is not attached to the pistons but fits the surface of the pistons. The flex barriers are hermetically secured to the interior surfaces of the cylinders to provide a hermetic seal between cylinders to provide a hermetic seal between the respective gas and liquid chambers. The liquid chambers are in fluid communication with the liquid inlet and liquid outlet. Diaphragm valves are arranged so that as liquid enters one of the liquid chambers, liquid exits out of the other liquid chamber, and vice versa. The gas chambers are in fluid communication with a gas inlet and a gas outlet. A manifold switching mechanism switches gas communication so that as gas enters into one of the gas chambers, gas exits out of the other gas chamber, and vice versa. Compressed gas is introduced into the gas system to drive the pistons. The manifold switching mechanism maintains the gas communication lines until the pistons reach the end or is at nearly the end of the stroke then switches the gas communication lines to reverse the direction of the pistons.

The liquid inlet is connected to a liquid source such as a soda syrup bag. When the liquid source is empty, a vacuum is created which actuates an automatic shut off valve. This automatic shutoff valve cuts off gas supply to the gas system within the pump which stops operation of the pump. The automatic shut off valve may be locked in the off position so that the user can replace the empty liquid source with a new full liquid source. Alternatively, the automatic shutoff valve may be manually actuated and locked in the off position. The shutoff valve may be locked in the off position with a twist and lock mechanism.

More particularly, a pressurized gas operated pump is disclosed which may comprise a first cylinder; a first piston linearly traversable within the first cylinder along a first axis; a first flexible seal hermetically sealed to an interior surface of the first cylinder and the first piston to define a first liquid chamber and a first gas chamber within the first cylinder, the first liquid chamber and the first gas chamber being on opposed sides of the first piston and the first flexible seal; a second cylinder; a second piston linearly traversable within the second cylinder along the first axis; a second flexible seal hermetically sealed to the interior surface of the second cylinder and the second piston to define a second liquid chamber and a second gas chamber, the second liquid chamber and the second gas chamber being on opposed sides of the second piston and the second flexible seal; an elongate shaft linearly traversable along the first axis, the first and second pistons being fixedly attached to the elongate shaft; a manifold for introducing gas into the first gas chamber while venting gas from the second gas chamber, and removing gas from the first gas chamber while introducing gas into the second gas chamber, the manifold being disposed adjacent to the second cylinder and the first cylinder being disposed adjacent to the second cylinder opposite from the manifold; a spool linearly traversable between first and second positions within the manifold along the first axis, the spool aligned in the first position to introduce compressed gas into the first gas chamber and to remove gas from the second gas chamber, the spool aligned to the second position to remove gas from the first gas chamber and to introduce gas into the second gas being attached to the shaft; first and second gas channels routed from the manifold to the first and second gas chambers.

The first and second cylinders may share a common dividing wall. The first piston, second piston and the spool may share a common linear traversal axis.

The pump may further comprise first and second liquid inlet check valves in fluid communication with the first and second liquid chambers. The first and second liquid inlet check valves being may be in a downstream direction.

The pump may further comprise first and second liquid outlet check valves in fluid communication with the first and second liquid chambers. The first and second liquid outlet check valves may be oriented in the downstream direction.

The spool may telescope with respect to the shaft. The pump may further comprise an intermediate member wherein the shaft telescopes with respect to the intermediate member and the intermediate member telescopes with respect to the spool.

The spool may defines one or more cavities which places the first and second gas chambers into fluid communication with an exhaust or a pressurized gas source depending on whether the spool is in first or second positions.

The spool may define a first cavity and a second cavity. The first cavity of the spool may be in fluid communication with the first gas chamber and a pressurized gas source and the second cavity of the spool may be in fluid communication with the second gas chamber and an exhaust when the spool is in the first position.

The first cavity of the spool may be in fluid communication with the first gas chamber and the exhaust and the second cavity may be in fluid communication with the second gas chamber and the pressurized gas source when the spool is in the second position.

In another embodiment, a method of operating a pump is disclosed. The method may comprise the steps of a) linearly traversing a shaft connected to first and second pistons while a spool is disposed at a first position; b) transferring gas from a pressurized gas source to a first gas chamber while the spool is disposed at the first position; c) transferring gas from a second gas chamber to an exhaust while the spool is disposed at the first position; d) transferring liquid from a liquid source to a second liquid chamber while the spool is disposed at the first position; e) transferring liquid from a first liquid chamber to a liquid outlet while the spool is disposed at the first position; f) traversing the spool from the first position to a second position; g) linearly traversing the shaft in an opposite direction while the spool is disposed at the second position; h) transferring gas from a pressurized gas source to the second gas chamber while the spool is disposed at the second position; i) transferring gas from the first gas chamber to the exhaust while the spool is disposed at the second position; j) transferring liquid from the liquid source to the first liquid chamber while the spool is disposed at the second position; k) transferring liquid from the second liquid chamber to the liquid outlet while the spool is disposed at the second position.

In the method, the spool may be stationary at the first position during steps b, c, d, e and the spool may be stationary at the second position during steps h, i, j, k.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
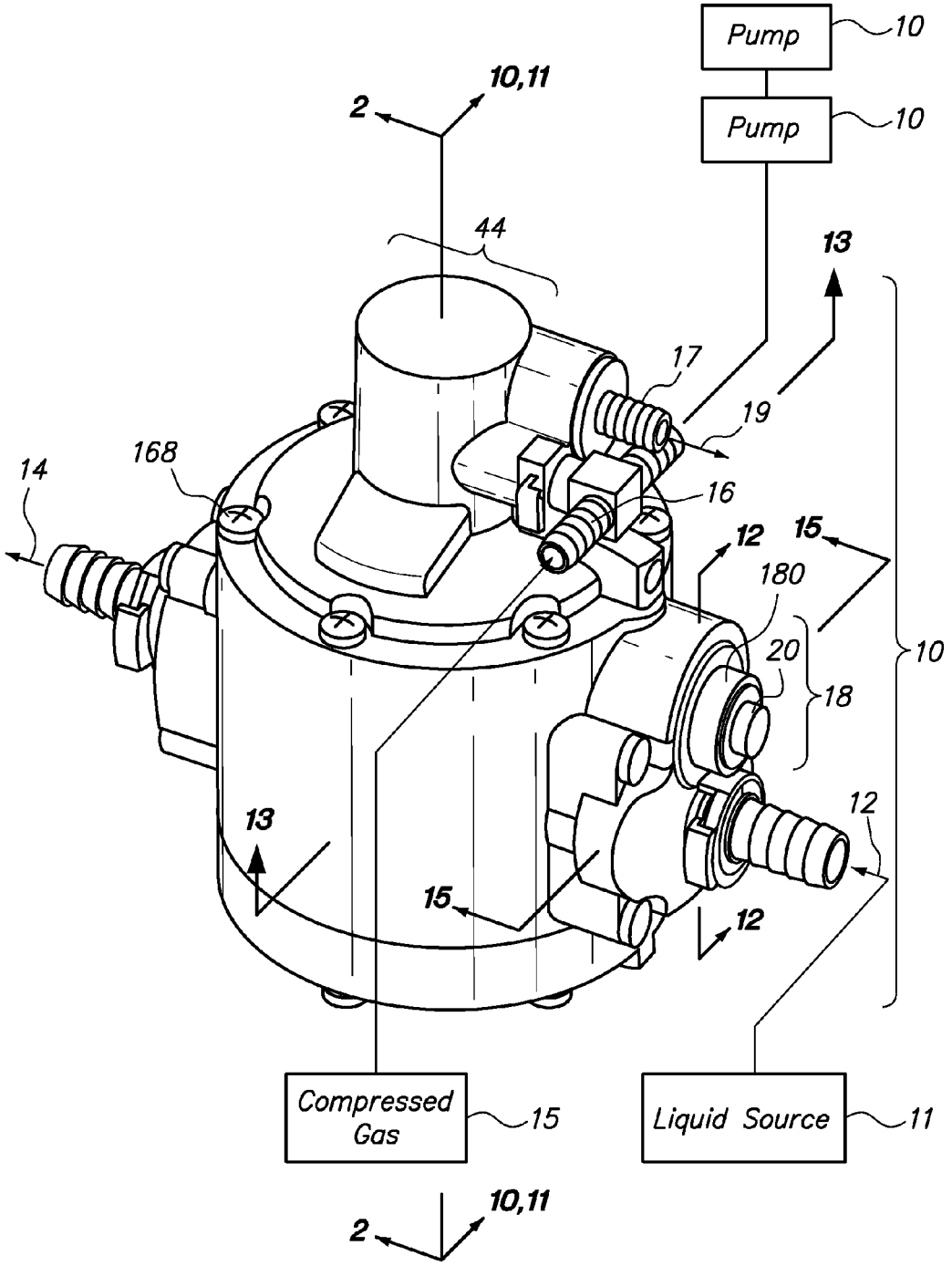
FIG. 1 is a perspective view of a compressed gas operated pump.

Referring now to the drawings, a pump 10 operated with compressed gas (e.g., carbon dioxide) is shown. A liquid source 11 (e.g., bag filled with liquid, soda syrup bag, etc.) is placed in fluid communication with a liquid inlet 12. The pump 10 flows liquid out of the liquid outlet 14 under power of the compressed gas. A compressed gas source 15 is placed in communication with a gas inlet 16. The compressed gas source 15 may be used to power additional pumps 10 by connecting one or more pumps 10 to the gas inlet 16. The compressed gas powers the pump 10 to force liquid from the liquid inlet 12 to the liquid outlet 14. After cycling the pump 10, the gas is exhausted out of a gas outlet 17 to the atmosphere through exhaust 19. In the event of depletion of the liquid from the liquid source 11, an automatic shut off valve 18 is actuated to stop the flow of compressed gas through the pump 10 and to stop operation of the pump 10. Liquid no longer flows through the pump 10. When stopped, the liquid source 11 can be replaced with a new full liquid source 11. It is also contemplated that the auto shut off valve 18 can be manually shut off by pushing button 20. The button 20 may be held in the off position with a 90 degree helical shut off and lock mechanism.

The pump 10 described herein has first and second cylinders 26, 28 with a manifold switching mechanism 44 off to one side of the first and second cylinders 26, 28. The manifold switching mechanism 44 shown and described herein is a single spool valve that exhausts gas from first gas chamber and introduces gas into a second gas chamber and reverses the process at the end of the stroke, then exhausts gas from the second gas chamber and introduces gas into the first gas chamber to drive the pump. This configuration as well as other aspects of the pump 10 reduces the cost to manufacture the pump 10 over prior art pump designs.

Figure 2:
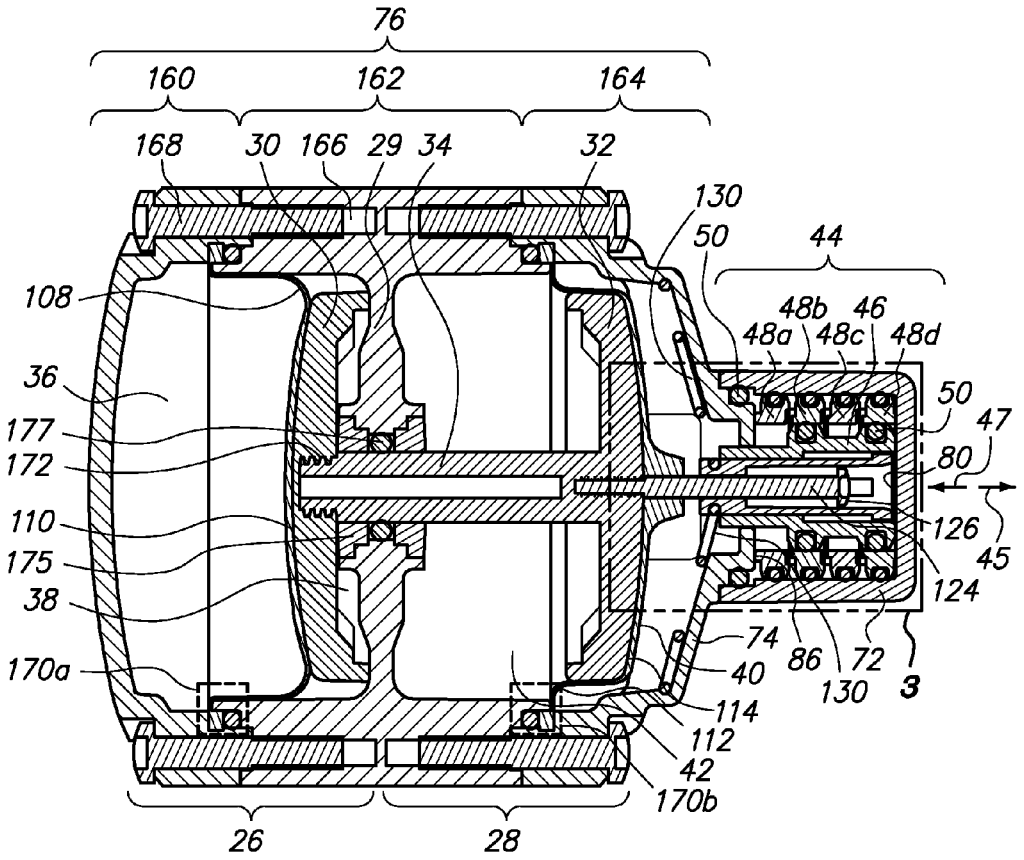
FIG. 2 is cross-sectional view of the pump shown in FIG. 1.

Referring to FIG. 2, the pump 10 has first and second cylinders 26, 28 which are separated by a common wall 29. First and second pistons 30, 32 are disposed within the cylinders 26, 28, mounted to a common shaft 34 and reciprocated along a longitudinal axis of the common shaft 34 within the cylinders 26, 28. The pistons 30, 32 and the shaft 34 are linearly traversed as a unitary structure from one side of the cylinder 26, 28 (see FIG. 2) to the opposite side of the cylinder 26, 28 (see FIG. 5). This provides for a more robust and reliable system. As the pistons 30, 32 are reciprocated, gas and liquid are introduced and vented from the first gas chamber 36, first liquid chamber 38, second gas chamber 40 and second liquid chamber 42. To this end, the pump 10 has a manifold switching mechanism 44 (see FIGS. 1 and 2) which introduces gas into the first gas chamber 36 and vents gas out of the second gas chamber 40 as the pistons 30, 32 and shaft 34 are traversed in the direction of arrow 45 from the position shown in FIG. 5. Near or at the end of the stroke in the direction of arrow 45, the manifold switching mechanism 44 re-routes the gas communication lines so that the compressed gas source 15 is now in gas communication with the second gas chamber 40 and the first gas chamber 36 is in gas communication with the exhaust 19. Near or at the end of the stroke in the direction shown by arrow 47, the manifold switching mechanism 44 re-routes the gas communication so that the compressed gas source 15 is now in gas communication with the first gas chamber 36 and the second gas chamber 40 is in gas communication with the exhaust 19. The compressed gas powers the pump 10 cycles through this process and reciprocates the pistons 30, 32 and shaft 34 until it is manually shut off or until the liquid source 11 is depleted of liquid.

Figure 3:
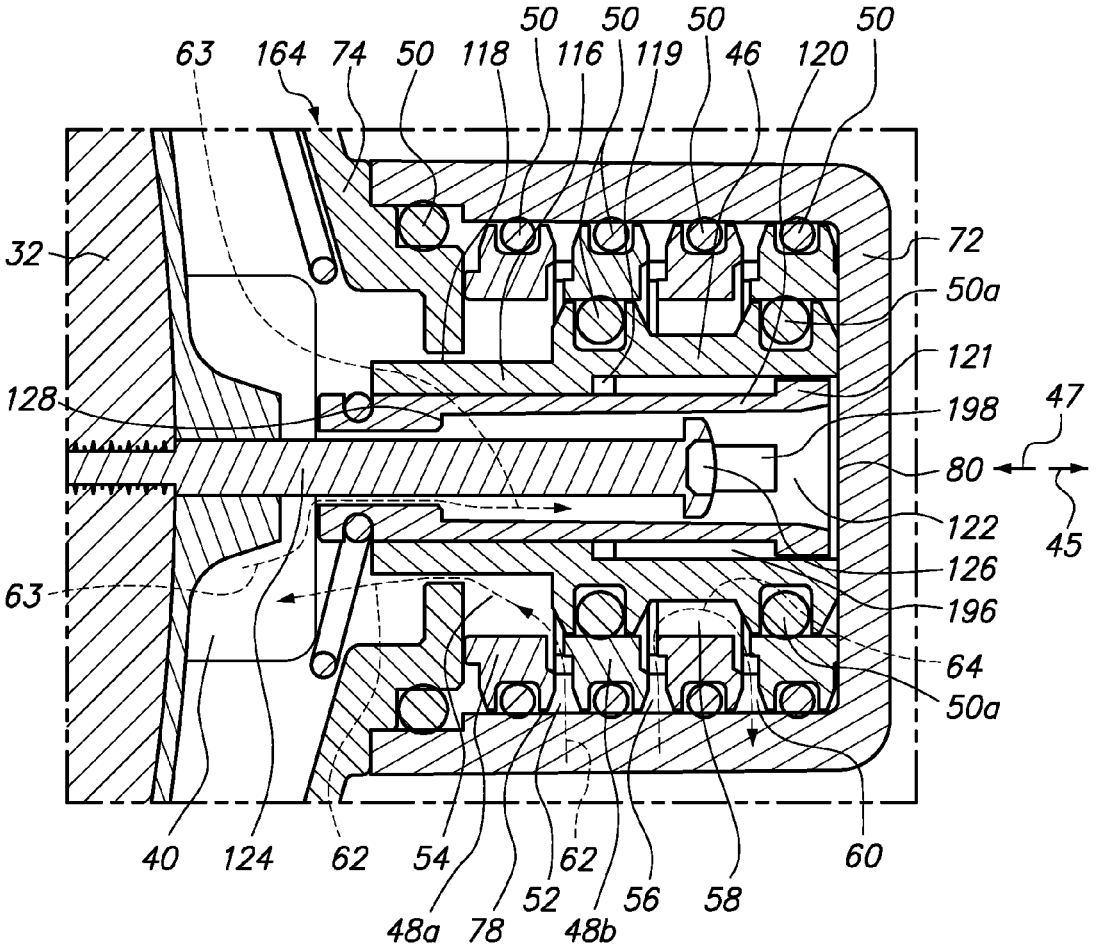
FIG. 3 is an enlarged view of a manifold switching mechanism shown in FIG. 2.
Figure 4:
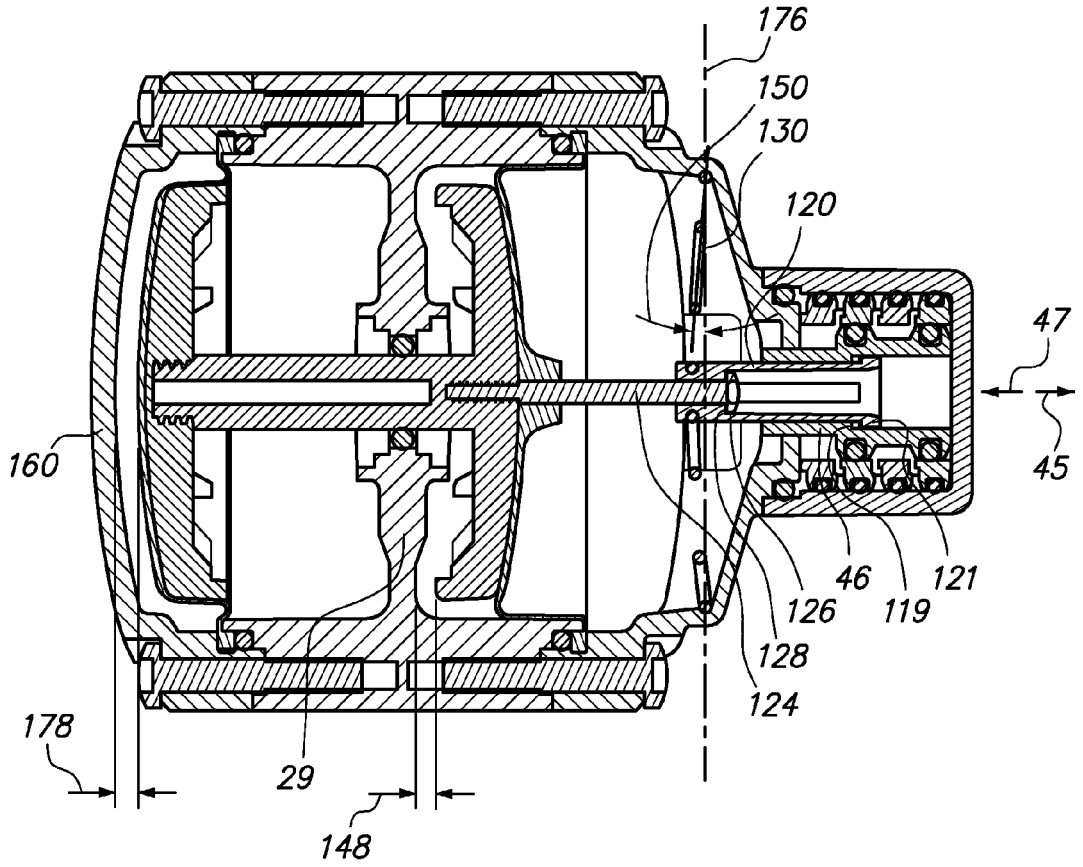
FIG. 4 is a cross-sectional view of the pump shown in FIG. 1 with the pistons shifted from the position shown in FIG. 2.
Figure 7:
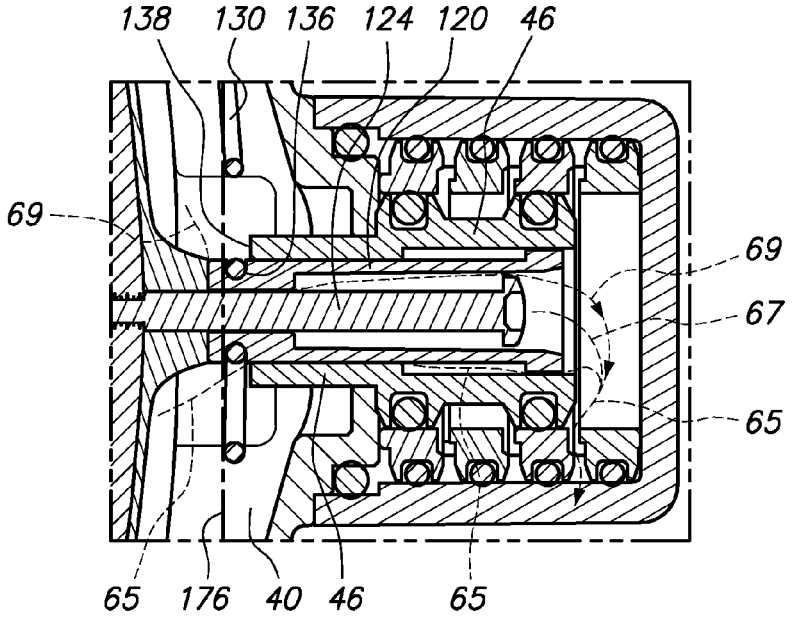
FIG. 7 is an enlarged view of the manifold switching mechanism shown in FIG. 6.
Figure 10:
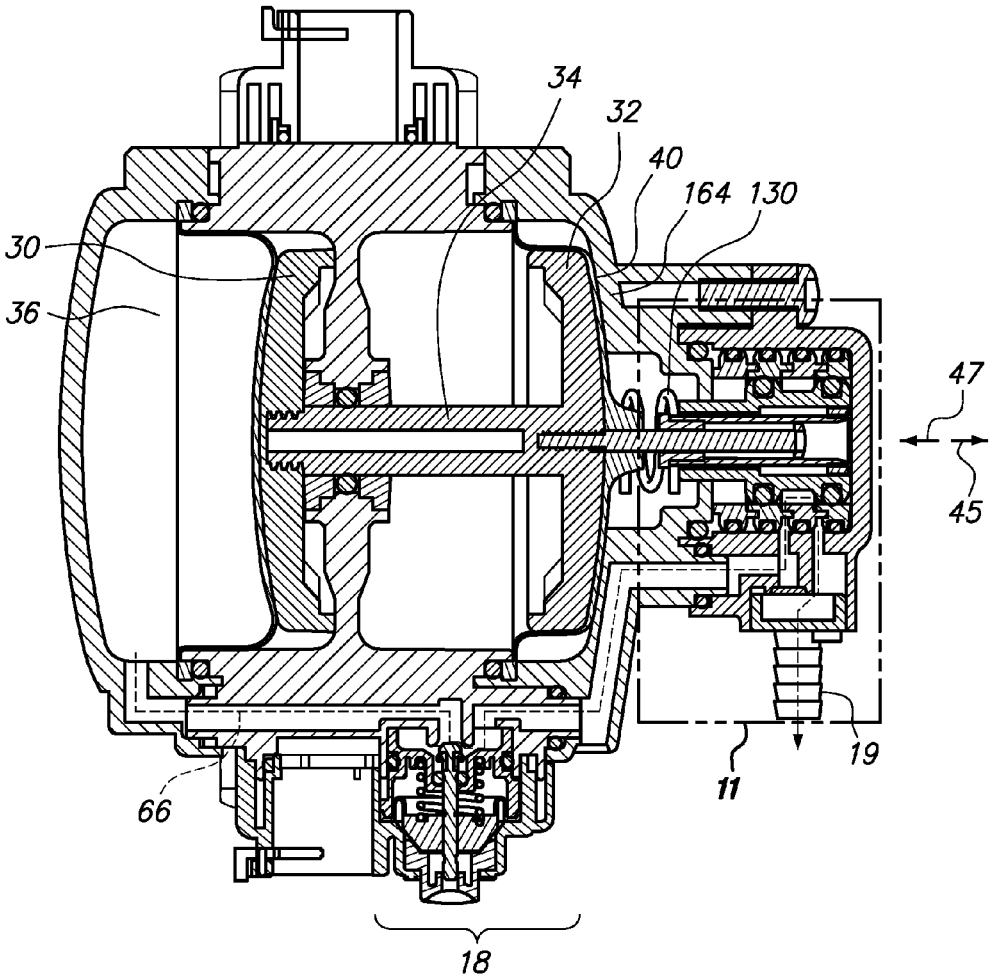
FIG. 10 is a cross-sectional view of the pump shown in FIG. 1 90° with respect to the cross-section shown in FIG. 2.
Figure 11:
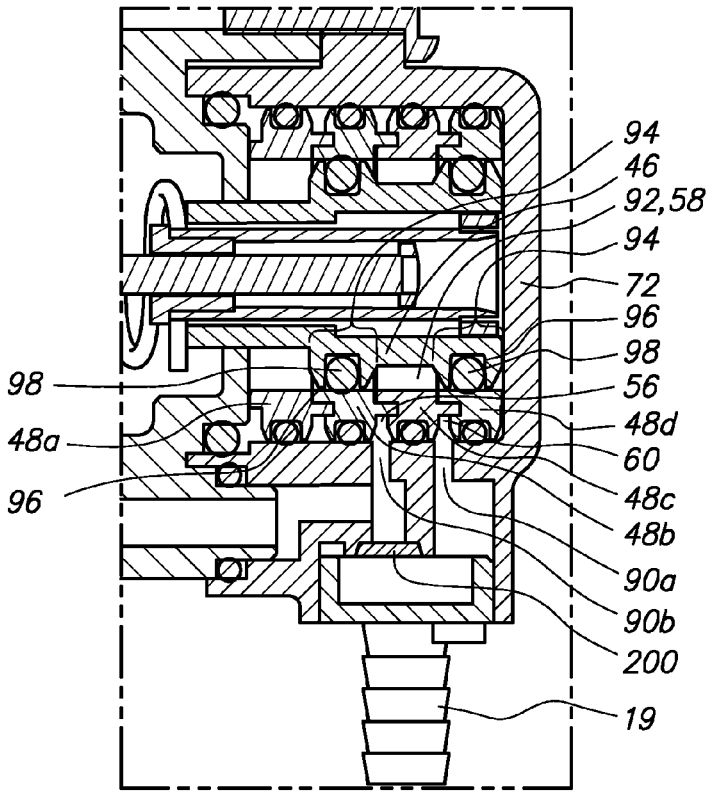
FIG. 11 is an enlarged view of the manifold switching mechanism shown in FIG. 10 and gas communication lines.

Near or at the end of the stroke in the direction shown by arrow 45 shown in FIGS. 2 and 3, a tubular shaped spool 46 is shifted in the direction of arrow 45. The spool 46 is mounted within a plurality of circular rings 48*a-d*. Rings 48*a-d* are also shown in FIGS. 16-23. O-rings 50 are mounted to the outer periphery of each of the rings 48*a-d* and the spool 46 to redirect the flow of gas between the rings 48*a, b*, 48*b, c*, 48*c, d*. When the spool 46 is in the position shown in FIG. 3, gas is allowed to flow from cavity 52 between rings 48*a, b* to cavity 54 as shown by arrow 62. The flow of gas travels through mating notches 84, 85 of the rings 48*a-d* (see FIGS. 21 and 22). Gas continues to flow into the gas chamber 40 (see FIG. 3) through a gap between the right portion 74 of the housing component 164 and the spool 46 to fill up the gas chamber 40. Gas also flows into the interior cavity 122 of the telescoping member 120 through a gap between the bolt 124 and the telescoping member 120 as shown by arrow 63. Gas flows to the interior cavity 196 of the spool 46 through slot 198 of the telescoping member 120. Gas flows between the distal end of the spool 46 and the flat end surface 80 of the housing 70 of the manifold switching mechanism 44 but is prevented from exhausting out due to the o-ring 50*a*. Referring still to FIG. 3, gas is also allowed to flow from cavity 56 to 58 then to 60 as shown by arrow 64. FIGS. 10 and 11 show the flow of gas out of the first gas chamber 36 through channel 66 to cavities 56, 58, 60 to exhaust 19. The compressed gas source 15 is introduced into the second gas chamber 40 as discussed above. As compressed gas is introduced into the right gas chamber 40, the shaft 34 and the pistons 30, 32 are shifted to the direction shown by arrow 47. Near or at the end of the stroke, the spool 46 is shifted to the direction shown by arrow 47 in FIG. 5. The compressed gas source 15 is now in gas communication with the first gas chamber 36. The compressed gas is introduced between rings 48*a, b* and routed to channel 66 to the first gas chamber 36. As compressed gas is introduced into the first gas chamber 36, the pistons 30, 32 and the shaft 34 are shifted in the direction of arrow 45. Gas within the second gas chamber 40 is routed to the exhaust 19 and released to the atmosphere as shown in FIG. 7. From the second gas chamber 40, gas is flowed between the telescoping member 120 and the spool 46 as shown by arrow 65. Gas also may flow to the inner cavity 122 of the telescoping member 120 through slot 198 (see FIG. 3) as shown by arrow 67. In FIG. 7, slot 198 of the telescoping member 120 is hidden behind the bolt 124. Additionally, to the extent that gas flows between the bolt 124 and the telescoping member 120 as shown by arrow 69, the gas is exhausted to the atmosphere through exhaust 19. The spool valve of the manifold switching mechanism is a three way spool valve which coordinates flow of gas into the gas chambers and to the exhaust.

Figure 5:
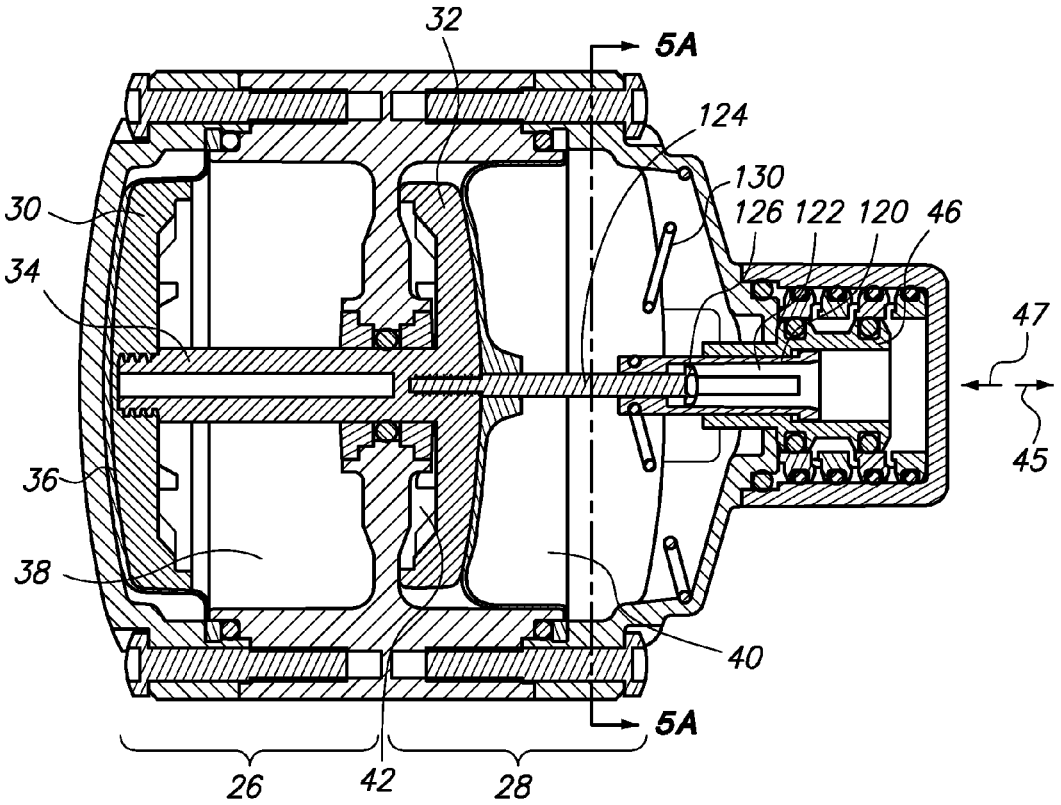
FIG. 5 is a cross-sectional view of the pump shown in FIG. 1 with the pistons at the end of the stroke and a spool also shifted.
Figure 13:
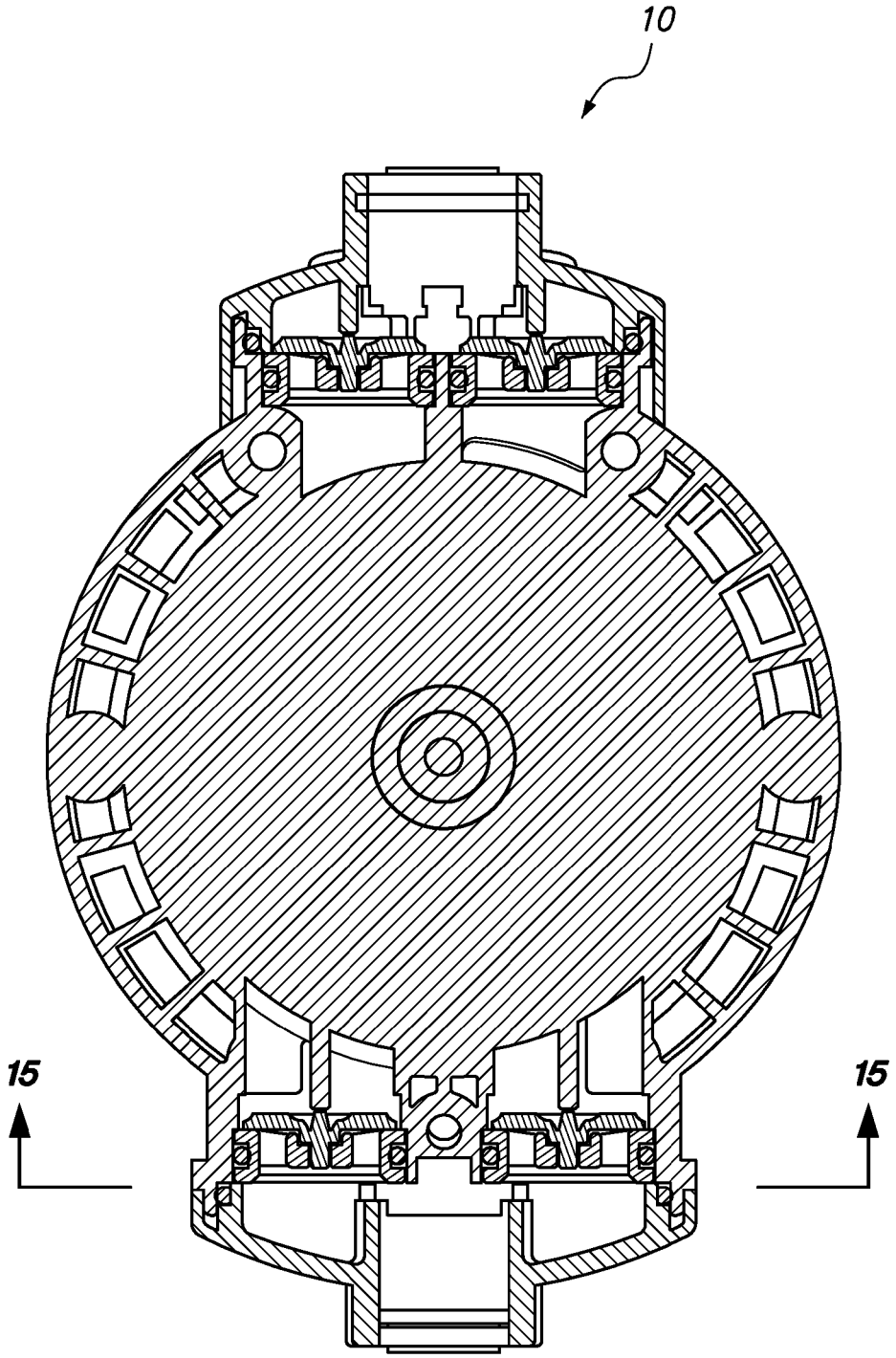
FIG. 13 is a cross-sectional view of the pump shown in FIG. 1.
Figure 14:
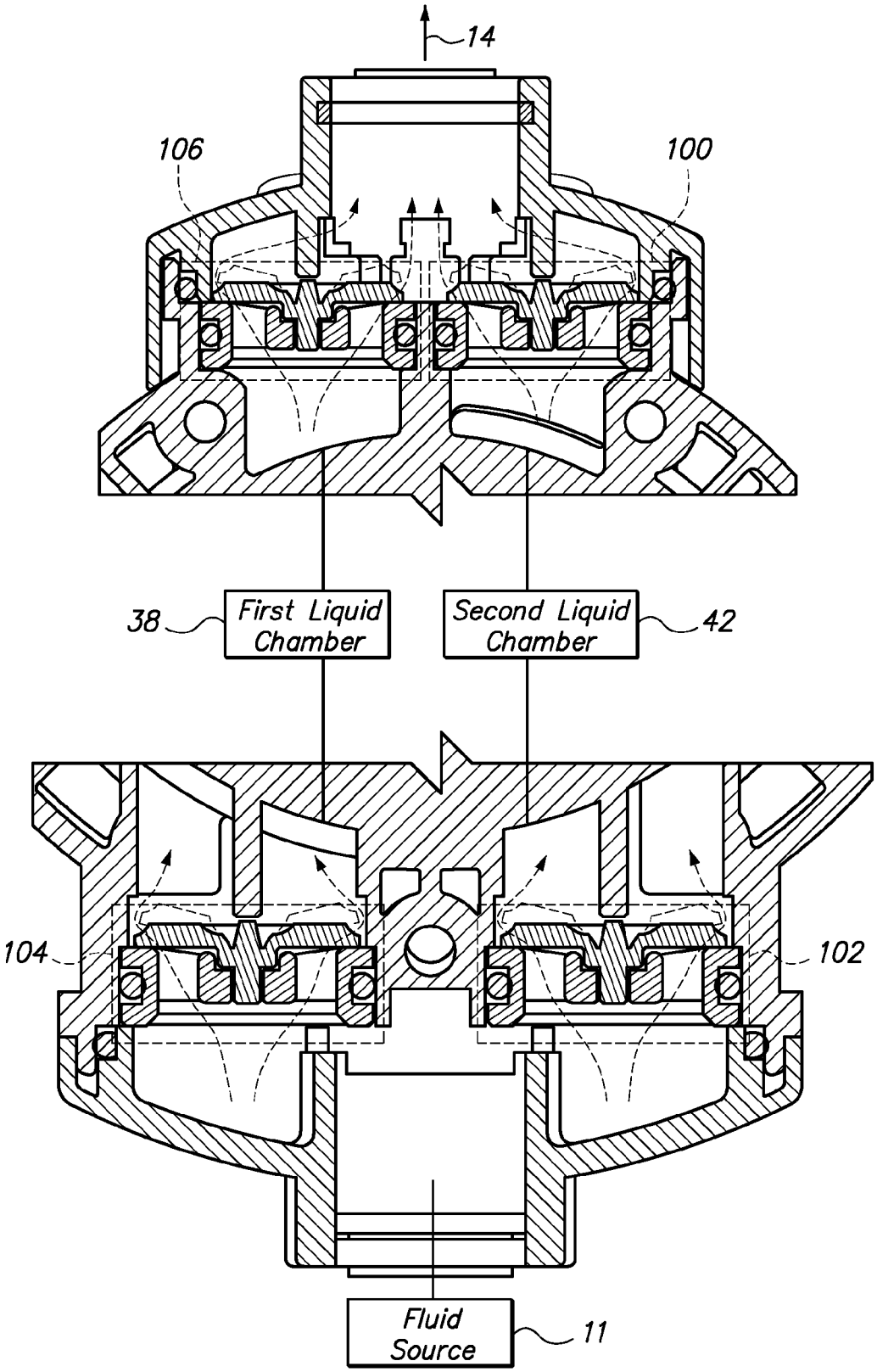
FIG. 14 is an enlarged schematic view of the pump shown in FIG. 13 as connected to first and second liquid chambers.
Figure 15:
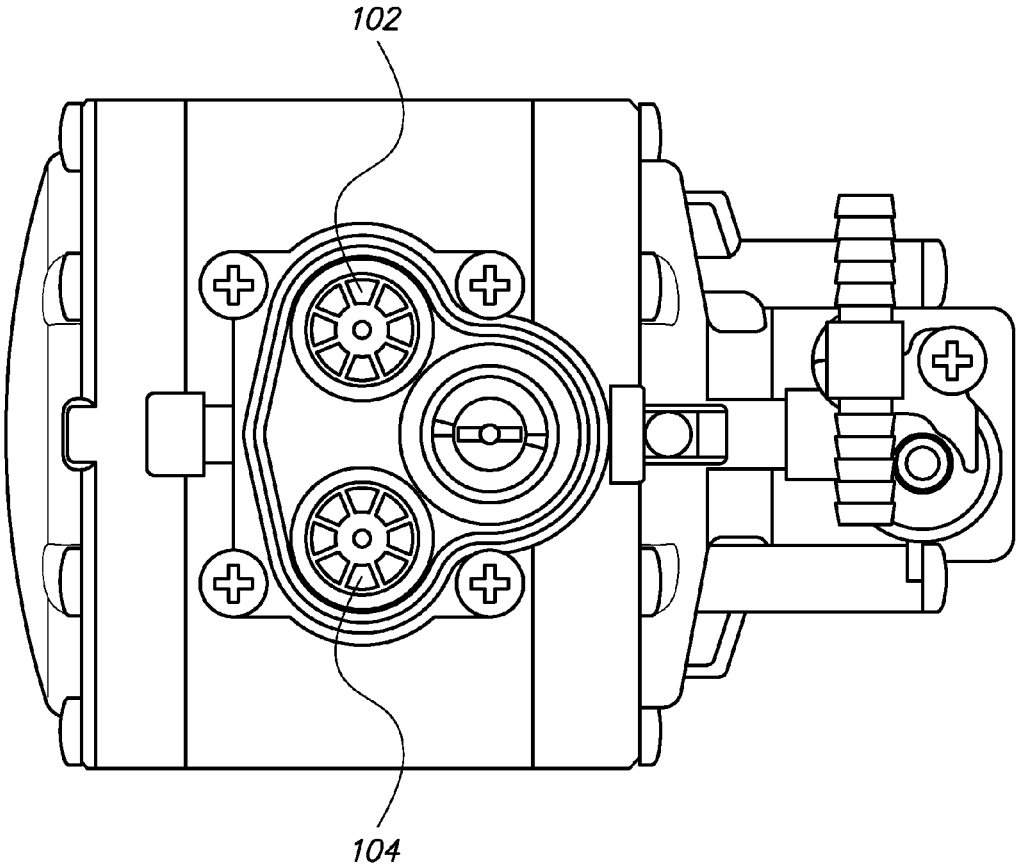
FIG. 15 is a cross-sectional view of the pump shown in FIG. 1.

Referring to FIGS. 5, 13 and 14, when the shaft 34 and pistons 30, 32 are traversed in the direction of arrow 45, liquid from the liquid source 11 is drawn into the second liquid chamber 42 and liquid in the first liquid chamber 38 is pumped out of outlet 14. Conversely, when the shaft 34 and pistons 30, 32 are traversed to the direction of arrow 47, liquid from the liquid source 11 is drawn into first liquid chamber 38 and liquid in the second liquid chamber 42 is pumped out of outlet 14 as shown in FIGS. 2 and 14. FIG. 13 is cross section of the pump as shown in FIG. 1. FIG. 14 is a schematic of the first and second liquid chambers 38, 42 in relation to the valves 100, 102, 104, 106 and the liquid inlet and outlet 12, 14. The compressed gas operates the pump to pump out liquid. The spool 46 remains in the position shown in FIG. 5 during traversal of the shaft 34 and pistons 30, 32 in the direction of arrow 45 to allow introduction and venting of gas to the first and second gas chambers 36, 40. Also, the spool 46 remains in the position shown in FIG. 2 during traversal of the shaft 34 and pistons 30, 32 in the direction shown by arrow 47 to allow venting and introduction of gas to the first and second gas chambers 36, 40. After introduction of gas and venting of the gas of the first and second gas chambers 36, 40 is accomplished as needed, the spool 46 shifts to the position shown in either FIG. 2 or 5.

The manifold switching system 44 includes the housing 72 (see FIG. 3) which is hermetically sealed to a portion 74 of the housing 76 of the first and second cylinder 26, 28 with o-ring 50. The internal surface 78 of the housing 72 of the manifold switching mechanism 44 is preferably cylindrical and has a flat end surface 80. Four circular rings 48*a-d* may be stacked upon each other to route gas between the rings 48*a-d*.

Figure 16:
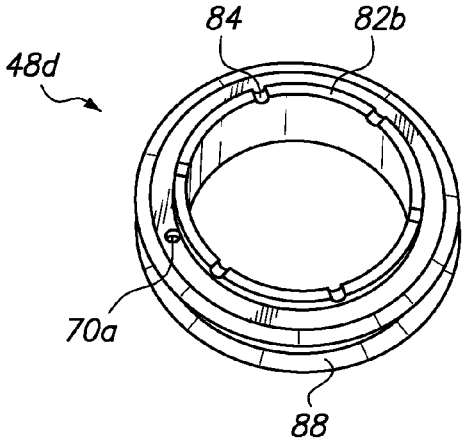
FIG. 16 is a perspective view of a ring.
Figure 17:
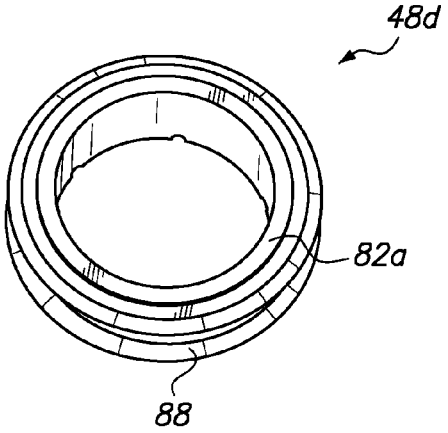
FIG. 17 is a perspective view of the other side of the ring shown in FIG. 16.
Figure 18:
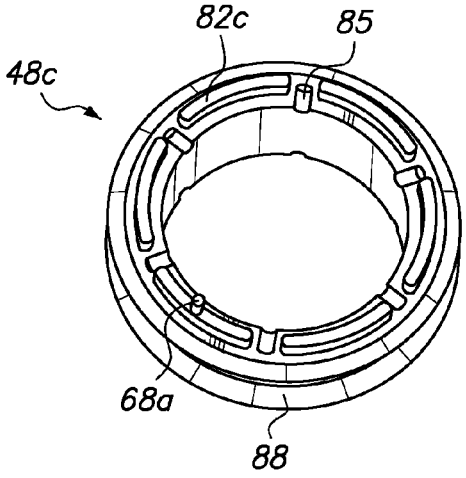
FIG. 18 is a perspective view of another ring.
Figure 19:
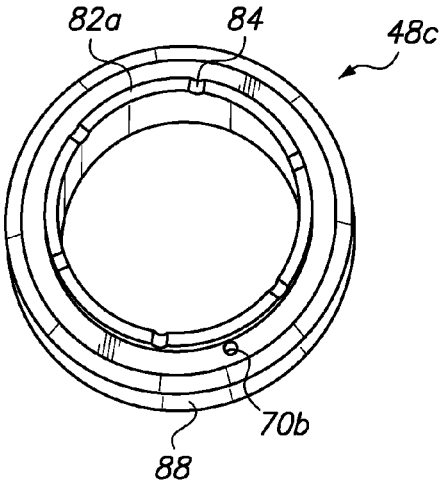
FIG. 19 is a perspective view of the other side of the ring shown in FIG. 18.
Figure 20:
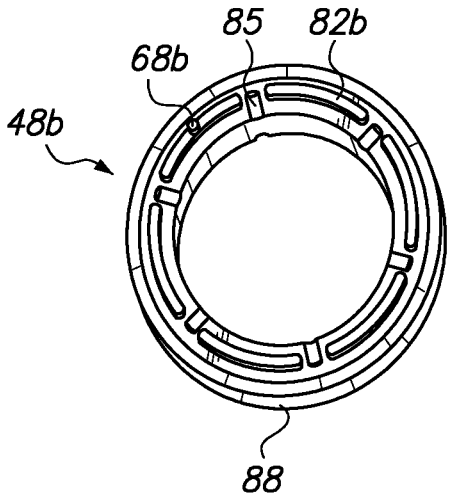
FIG. 20 is a perspective view of another ring.
Figure 21:
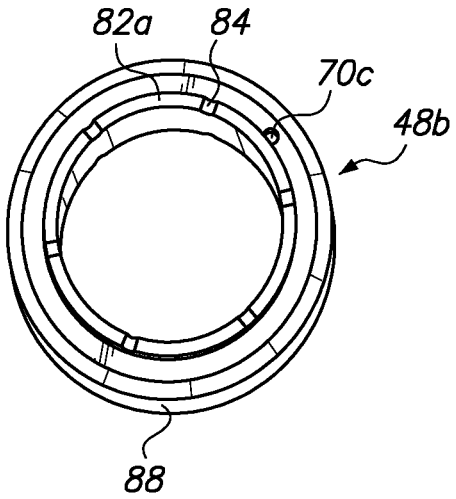
FIG. 21 is a perspective view of the other side of the ring shown in FIG. 20.
Figure 22:
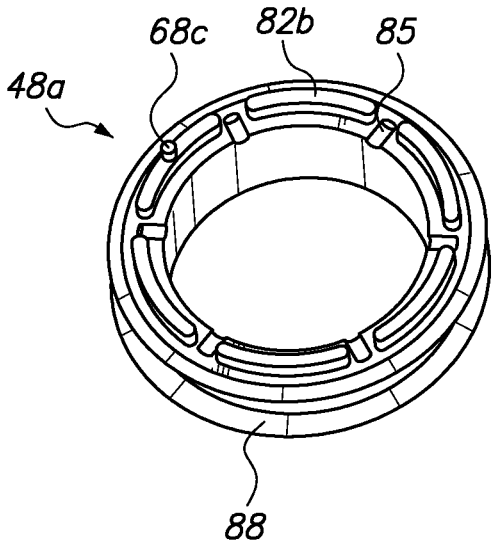
FIG. 22 is a perspective view of another ring.
Figure 23:
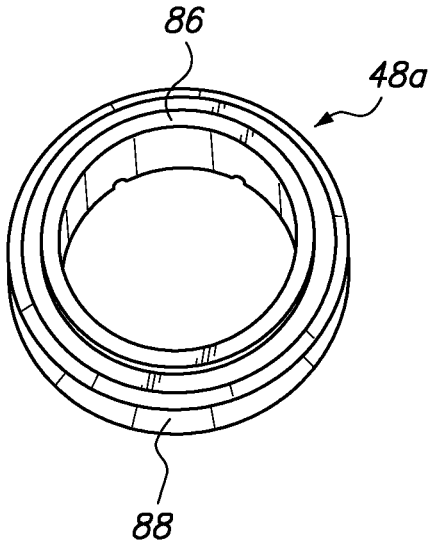
FIG. 23 is a perspective view of the other side of the ring shown in FIG. 22.

The rings 48*a-d* are shown in FIGS. 16-23. FIGS. 16 and 17 show both sides of ring 48*d*. FIGS. 18 and 19 show both sides of ring 48*c*. FIGS. 20 and 21 show both sides of ring 48*b*. FIGS. 22 and 23 show both sides of ring 48*a*.

The rings 48*a-d* are stacked upon each other and locked into angular position by pins 68*a, b, c* and holes 70*a, b, c*. The side of ring 48*d* shown in FIG. 17 abuts the flat end surface 80 (see FIG. 3) of the housing 72. The ridge 82*a* of ring 48*d* is sealed against the flat end surface 80. Such contact creates a generally gas seal to prevent or substantially reduce the flow of gas from the outer periphery of the ring 48*d* to the inner periphery.

The ring 48*c* is shown in FIGS. 18 and 19. Pin 68*a* of the ring 48*c* shown in FIG. 18 is inserted into the hole 70*a* of the ring 48*d* shown in FIG. 16. The ridge 82*b* of ring 48*d* is received into the inner periphery of the ridge 82*c* of the ring 48*c*. A generally gas seal is formed between the ridges 82*b, c*. As shown, the ridge 82*b* has notches 84 formed as generally semi circular grooves. These notches 84 are aligned to the notches 85 shown in FIG. 18. The notches 84 and 85 allow gas to flow between the inner cavity of the corresponding rings 48*a-d* and the outer space (e.g., cavity 52, 56, 60, see FIG. 3). The respective notches 84 and 85 in the rings 48*a-d* as discussed herein allow gas to travel between the inner cavity (i.e., inner periphery) and the outer cavity (i.e., outer periphery) of the corresponding pair of rings 48*a-d*.

The ring 48*c* shown in FIG. 19 also has notches 84. The ring 48*b* also has ridges 82*b* and notches 85 as shown in FIG. 20. Pin 68*b* of the ring 48*b* shown in FIG. 20 is inserted into the hole 70*b* of the ring 48*c* shown in FIG. 19. The notches 84 are aligned to the notches 85 (see FIGS. 19 and 20) to allow gas communication between the inner and outer cavities of the corresponding rings 48*a-d*.

Moreover, the ring 48*a* has a pin 68*c*, ridges 82*b* and notches 85 as shown in FIG. 22. The pin 68*c* of the ring 48*a* shown in FIG. 22 is inserted into the hole 70*c* of the ring 48*b* shown in FIG. 21. The notches 85 of the ring 48*a* and the notches 84 formed in the ridge 82*a* are aligned to each other to provide gas communication between the inner and outer cavities of the corresponding rings 48*a-d*. Ridge 86 (see FIG. 23) of the ring 48*a* contacts the portion 74 of the housing 76 as shown in FIG. 2.

Figure 24:
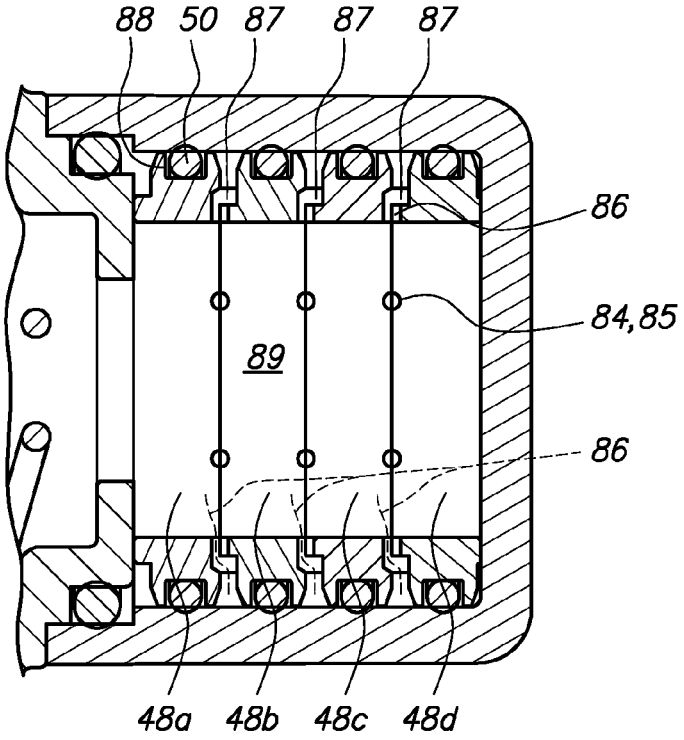
FIG. 24 is an enlarged view of the manifold switching mechanism showing the rings of FIGS. 16-23 stacked upon each other and fitted within a housing of the manifold switching mechanism.

The stacked rings 48*a-d* are shown in FIG. 24. As shown, the notches 84, 85 form a conduit 87 that allows gas to flow from the inner cavity of the respective rings 48*a-d* to the outer cavity. The cross sections of the conduits 87 are shown to allow flow of gas as shown by dash gas line 86. Each of the rings 48*a-d* has an o-ring groove 88 which receives an o-ring 50, as shown in FIG. 24. The o-ring 50 prevents gas from transferring laterally between rings 48*a-d*. The spool 46 may be placed in the position shown in FIG. 2.

Figure 25:
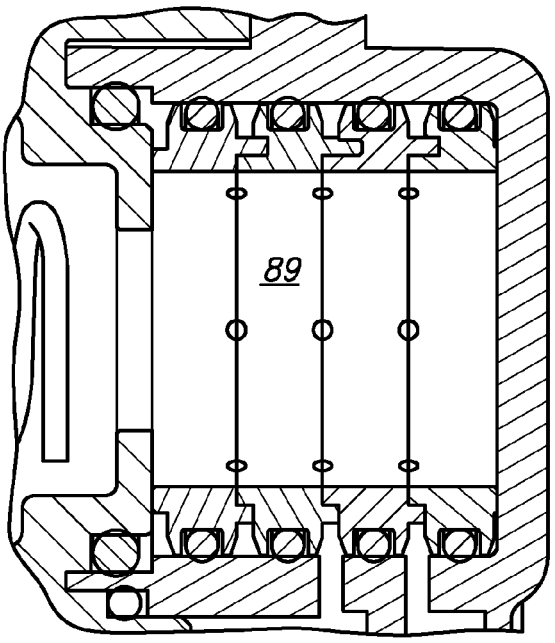
FIG. 25 is a cross-sectional view of the manifold switching mechanism and the rings at a cross section 90° with respect to the cross section shown in FIG. 24.

The housing 72 of the manifold switching mechanism 44 may have gas channel 90*a, b* (see FIGS. 10 and 11). Gas channel 90*a* leads to exhaust 19. Gas channel 90*b* as shown in FIG. 10 leads to the first gas chamber 36. It is plugged or stopped with a plug 200 to prevent gas from flowing into the exhaust 19. As the shaft 34 and the piston 30, 32 are traversed in the direction of arrow 47, the gas within the first gas chamber 36 flows through channel 66 out through channel 90*b*, through conduits 87 formed by notches 84, 85 and through channel 90*a*. The spool 46 re-routes gas to the conduits 87 formed by notches 84, 85 of the rings 48*b, c* and rings 48*c, d*. Gas is exhausted out of the exhaust line 19. Gas is introduced into the second gas chamber 40 from the gas source as discussed above. The spool 46 has a groove 92 separated by two walls 94. The walls 94 additionally have o-ring grooves 96 which receive o-rings 98. The o-rings 98 provide a hermetic seal against the interior cylindrical surface 89 (see FIG. 25) formed by the stacked rings 48*a-d*.

Referring now to FIGS. 2, 5 and 14, the liquid system of the pump 10 will be discussed. When the shaft 34 and pistons 30, 32 are in the position shown in FIG. 2, the second liquid chamber 42 is filled with liquid and liquid from the first liquid chamber 38 has been pumped out through the liquid outlet 14. As gas is introduced into the second gas chamber 40, the shaft 34 and the pistons 30, 32 are traversed in the direction shown by arrow 47. In doing so, positive pressure is created within the second liquid chamber 42. The diaphragm check valve 100 (see FIG. 14) which is fluidically connected to the second liquid chamber 42 is opened to allow liquid from the second liquid chamber 42 to flow out of the liquid outlet 14. The input check valve 102 which is also fluidly connected to the second liquid chamber 42 remains closed. During this process, a vacuum is created within the first liquid chamber 38. The vacuum opens the first input check valve 104 which is fluidically connected to the liquid source 11 to introduce liquid from the liquid source 11 into the first liquid chamber 38. Simultaneously, the first output check valve 106 which is also fluidly connected to the first liquid chamber 38 remains closed. At the end of the stroke in the direction shown by arrow 47 (see FIG. 5), the shaft 34 and pistons 30, 32 begin their traversal in the direction shown by arrow 45. Pressure is created within the first liquid chamber 38 which causes the first output check valve 106 (see FIG. 14) to open in order to pass liquid through the liquid outlet 14. The input check valve 104 remains closed. Simultaneously, the liquid from the liquid source 11 is introduced into the second liquid chamber 42 through input check valve 102, since the vacuum in created within the second liquid chamber 42. Moreover, the second output check valve 100 remains closed. The check valves 100, 102, 104 and 106 are diaphragm check valves. However, other types of check valves are also contemplated that are known in the art or developed in the future.

The first gas and liquid chambers 36, 38 are separated by the piston 30 and a flexible barrier 108 (see FIG. 2) which provides a seal between the first gas and liquid chambers 36, 38 so that gas is not introduced into the first liquid chamber 38 and liquid is not introduced into the first gas chamber 36. The flexible barrier 108 may rests on the surface 110 of the piston 30. The flex barrier 108 is not attached to the surface 110 of the piston 30. An outer periphery of the flex barrier 108 is secured between the first and middle housing components 160, 162. Similarly, the second gas and liquid chambers 40, 42 may be separated by piston 32 and flex barrier 112. The flex barrier 112 may rests on the piston surface 114 of piston 32. An outer periphery of the flex barrier 112 is secured between the middle and second housing components 162, 164. The flex barrier 112 prevents gas from the second gas chamber 40 from leaking into the second liquid chamber 42. Conversely, the flex barrier 112 prevents liquid from the second liquid chamber 42 from leaking into the second gas chamber 40. The gas system of the pump 10 is separate from the liquid system. The flex barriers 108, 112 may flex or stretch to the position shown in FIGS. 2 and 5. The flex barriers 108 and 112 are not over molded onto the pistons 30, 32. The flex barriers 108 and 112 are not attached to the pistons 30, 32 but is merely in contact with the surfaces 110, 114. As gas is introduced into the first gas chamber, the gas presses the first flex barrier 108 against the first piston 30. The second piston 32 is pressing against the second flex barrier 112. In reverse, as gas is introduced into the second gas chamber, the gas presses the second flex barrier 112 against the second piston 32. The first piston 30 is now pressing against the first flex barrier. This structure and arrangement of the flex barriers 108, 112 reduce the cost to manufacture and simplifies the manufacturing process for the pistons 30, 32 and the flex barriers 108, 112 assembly.

The flex barriers 108, 112 may have a circular shape so as to match the interior circular shape of the first and second cylinders 26, 28. The outer periphery of the flex barriers may have a bead and be trapped between the first and middle housing components 160, 162 and the middle and second housing components 162, 164 at 170*a, b*. The pistons 30, 32 may define the surfaces 110, 114 respectively. The flex barriers 108, 112 are not attached to the surfaces 110, 114. In one aspect of the pump 10, the flex barriers 108, 112 are not molded over the pistons 30, 32 to reduce the cost of manufacturing the pump 10. The flex barriers 108, 112 are fabricated from a flexible material but may also be fabricated from an elastomeric material.

Referring now to FIGS. 2-7, the spool 46 is telescopically connected to the shaft 34 and pistons 30, 32. In particular, the spool 46 has a cylindrical extension 116 (see FIG. 3). This cylindrical extension 116 is received into a mating round aperture 118 of the portion 74 of the second housing component 164. The inner cavity of the spool 46 has a lip 119 which extends around the inner periphery of the spool 46. An inner telescoping member 120 slides longitudinally within the spool 46. The telescoping member 120 has a ridge 121 which contacts the lip 119 of the spool 46 as the shaft 34, pistons 30 and 32 are traversed in the direction of arrow 47. The telescoping member 120 shifts the spool 46 toward the position shown in FIG. 5. The telescoping member 120 additionally has an interior cavity 122. A bolt 124 which is fixedly attached to the second piston 32 (e.g., threaded attachment) slides within the cavity 122. More particularly, a head 126 of the bolt 124 is traversed within the interior cavity 122. The head 126 of the bolt 124 contacts a ledge 128 of the telescoping member 120 as the shaft 34 and pistons 30, 32 are traversed in the direction of arrow 47. As the shaft 34, pistons 30, 32 are traversed in the direction of arrow 47, the bolt 124 moves in unison with the shaft 34. As the shaft 34 and pistons 30, 32 are traversed in the direction of arrow 47, the spool 46 remains in the position shown in FIG. 2. The head 126 of the bolt 124 is traversed within cavity 122 of the telescoping member 120. The head 126 ultimately contacts the ledge 128 of the telescoping member 120 (see FIG. 4) and begins to move the telescoping member 120 in the direction of arrow 47. A serpentine spring 130 (see FIG. 5A) biases the telescoping member 120 and the spool 46 toward the position shown in FIG. 2. When the head 126 of the bolt 124 contacts the ledge 128, the serpentine spring 130 begins to compress and goes over center 176 (see FIG. 4). As soon as the spring 130 goes over the center, the spring 130 begins to expand and push the telescoping member 120 in the direction of arrow 47. The ledge 121 of the telescoping member 120 contacts the lip 119. The spring 130 pushes the telescoping member 120 and the spool 46 in the direction of arrow 47 as shown in FIG. 5.

Figure 5A:
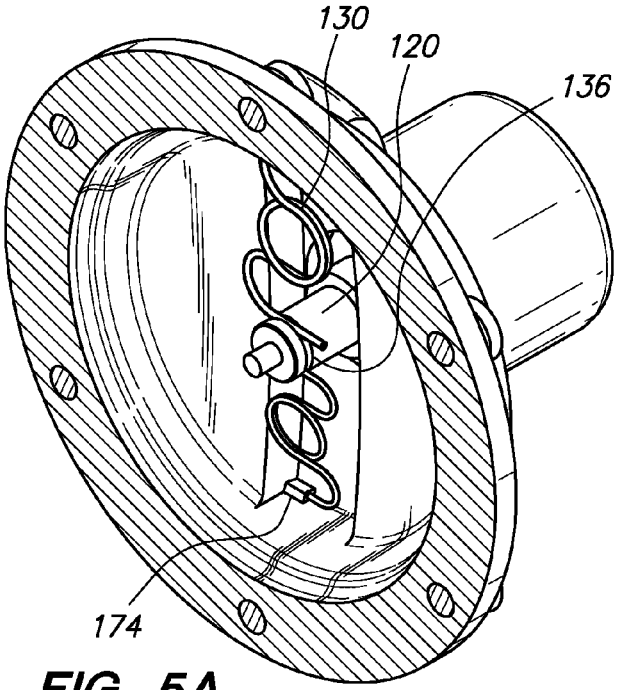
FIG. 5A is perspective view of a spring which operates the spool as mounted in the pump.
Figure 6:
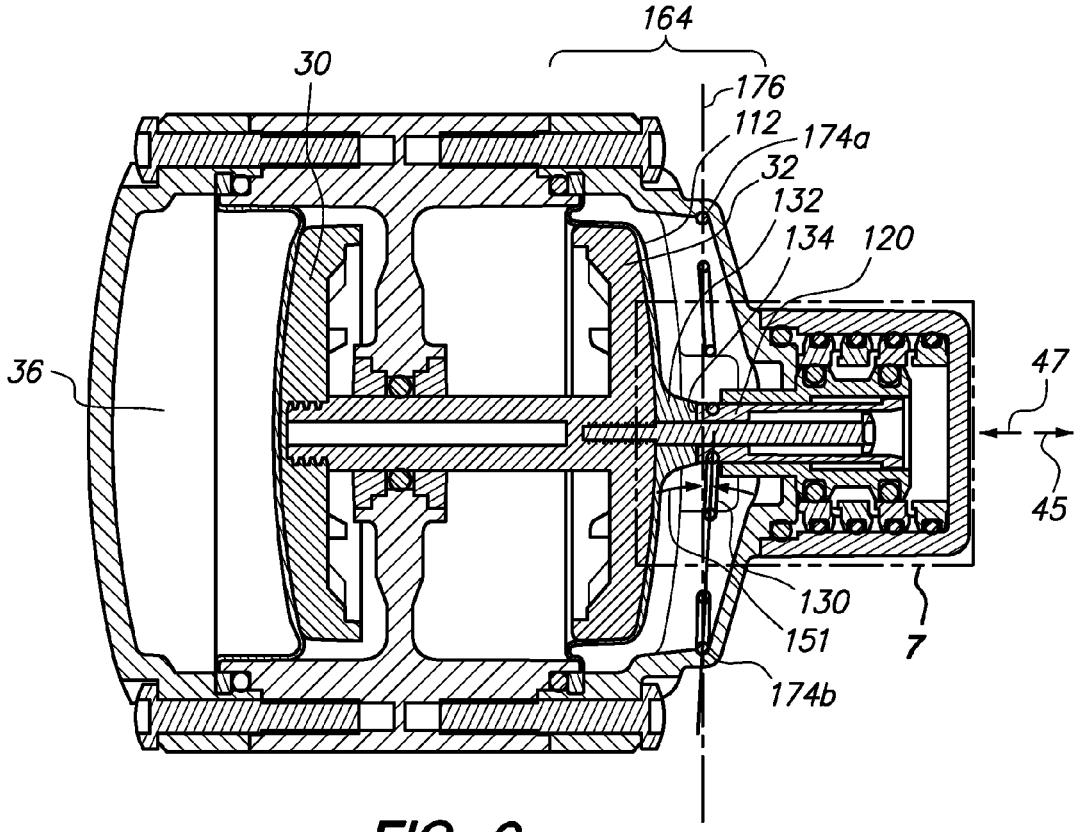
FIG. 6 is a cross-sectional view of the pump shown in FIG. 1 with the pistons on the return stroke.
Figure 8:
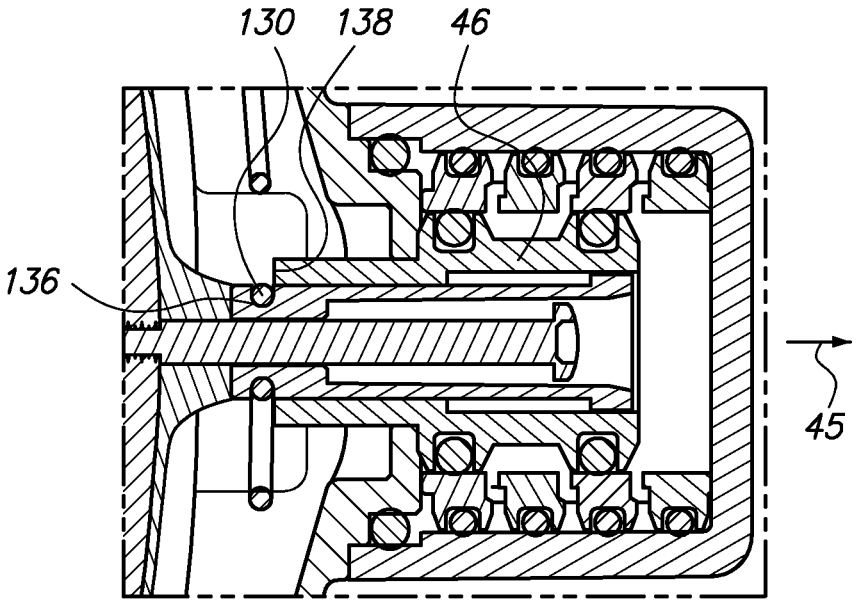
FIG. 8 is an enlarged view of the manifold switching mechanism just prior to a spring contacting the spool.
Figure 9:
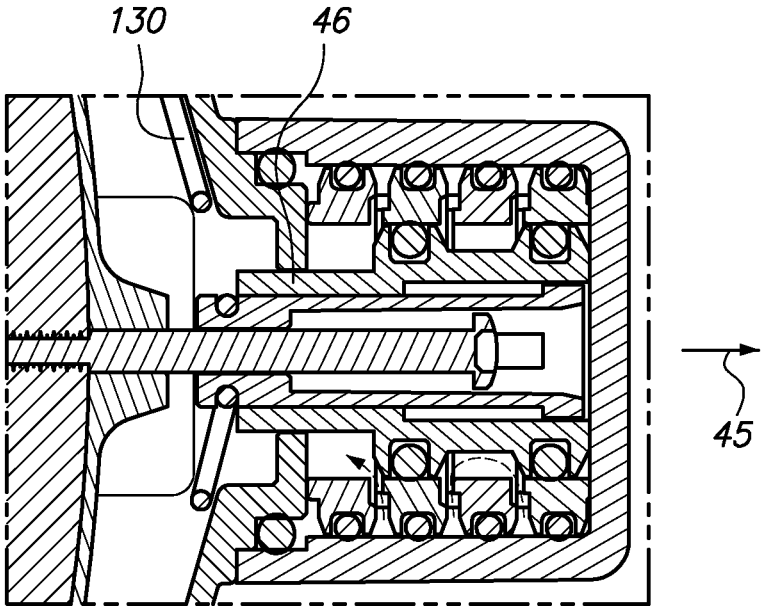
FIG. 9 is an enlarged view of the manifold switching mechanism wherein the spring contacted the spool and traversed the spool.

As the shaft 34 and pistons 30, 32 are traversed in the direction of arrow 45, head 126 of the bolt 124 slide within the interior cavity 122 of the telescoping member 120. The pistons 30 and 32 are traversed in the direction of arrow 45 under the power of the compressed gas as discussed above. The second piston 32 contacts the telescoping member 120 as shown in FIG. 6. More particularly, as shown in FIG. 6, the flex barrier 112 has a footing 132 which contacts base 134 of the telescoping member. As the piston 32 and flex barrier 112 traverse the telescoping member 120 in the direction of arrow 45, the spring 130 eventually goes over center 176 and expands rapidly. The spring 130 is engaged in a groove 136 of the telescoping member 120 (see FIGS. 5A and 7). The spring 130 contacts the distal end 138 of the spool 46 as shown in FIG. 8. When the spring 130 expands, the spring 130 pushes the spool 46 in the direction of arrow 45 as shown in FIG. 9. As can be seen, there is a delayed response of the shifting of the spool 46 until the shaft 34 and pistons 30, 32 are almost at the end of the stroke. In this way, the gas communication line to the exhaust 19 and the inlet 16 remain in the proper configuration to allow gas to be introduced or vented out of the gas chambers 36, 40 as needed.

Figure 12:
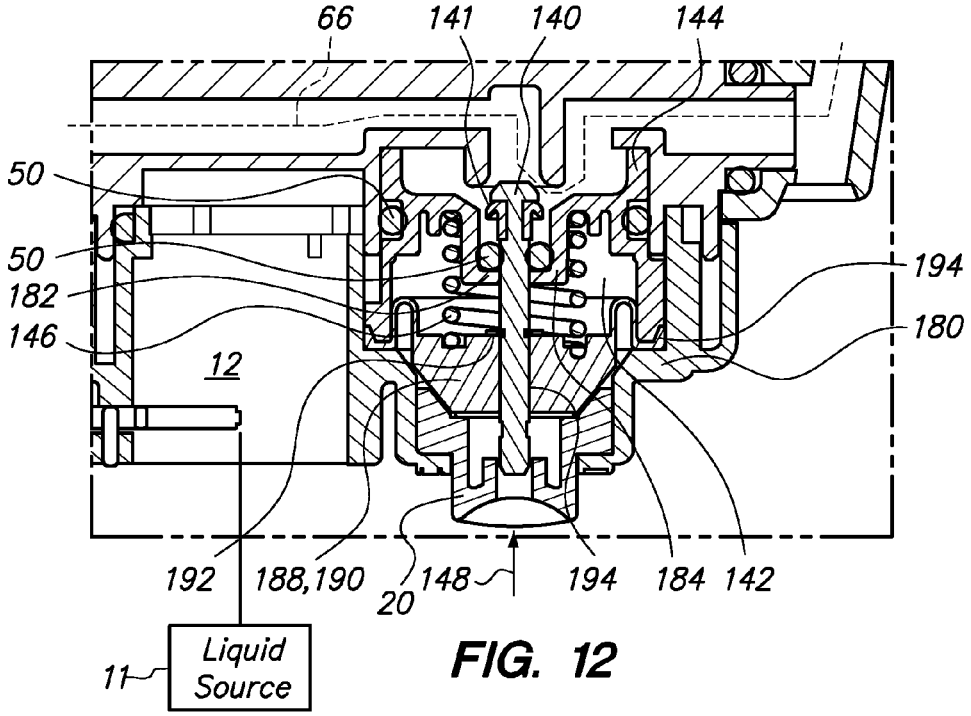
FIG. 12 is an enlarged cross-sectional view of an auto shut off shown in FIG. 1.

Referring now to FIGS. 1, 10 and 12, the pump 10 additionally has a shut off valve 18 integrated into the body of the pump and shuts off entrance of gas into the first gas chamber 36 to stop operation of the pump. The shut off valve 18 when actuated, shuts off the flow of air through gas channel 66 (see FIG. 10). As shown in FIG. 12, the pin 140 and rubber seal 141 are normally retracted from channel 66. When the liquid source 11 is empty, a vacuum is created at the inlet 12. This vacuum is communicated to cavity 142 between button 20 and a shut off valve housing wall 144. The vacuum overcomes a bias force of spring 146. The spring 146 biases the button 120 and the pin 140 to the retracted position as shown in FIG. 12. The vacuum, when present, urges the pin 140 and the seal 141 into the channel 66 and shuts off the flow of air within channel 66. The rubber seal 141 has a mushroom configuration to allow gas to exhaust out of the first gas chamber 36 but not enter the first gas chamber 36 when the seal 141 and pin 140 are urged into the channel 66. When the operation of the pump is stopped, the pistons 30, 32 continue to cycle until it reaches the position shown in FIG. 5. This protects the pump from an internal high load situation. The operation of the pump 10 is also stopped since compressed gas is no longer allowed to flow through the pump 10. The user can lock the button 20 in the extended position through a 90° twist lock mechanism of the button 20. The liquid source 11 can be replaced with a new liquid source 11. The button 20 can be disengaged to allow compressed gas to flow back through the system of the pump 10 and begin operation of the pump 10. Alternatively, the shutoff valve 18 can be manually pressed by depressing the button 20 in the direction of arrow 148 and locked with the twist lock mechanism by hand.

More particularly, referring to FIG. 12, the auto shut off valve 18 may include the housing wall 144, an exterior housing 180, and the button 20. The housing wall 144 may have a cylindrical shape with the cross section shown in FIG. 12. The housing wall 144 may be secured to one or more of the first, middle or second housing components 160, 162, 164 as the case may be in optimizing the design of the pump 10. The housing wall 144 may have an aperture 182 which receives actuating pin 140. The actuating pin 140 is held in place by the aperture 182 and reciprocates within the aperture 182. The distal end of the pin 184 holds the rubber seal 141 within the groove as shown. The housing wall 144 may also have spring seat structure 184 to hold a spring 146 in place. The spring 146 may be a helical coil compression spring which biases the button 20 and a base 190 of the rubber seal 141 in the retracted position as shown in FIG. 12. The o-rings 50 identified and shown in FIG. 12 provide a hermetic seal. The exterior housing 180 of the shut off valve 18 may be mounted onto the housing wall 144. The rubber seal 188 may be disposed on the other side of the spring 146. The spring 146 pushes against the base 190 of the rubber seal 188 to bias the base 190 to the retracted position. As shown, the pin 140 is engaged to the base 190 of the rubber seal by way of c-ring 192. Also, the pin 140 is received through aperture 194 of the base 190 and may extend to the button 20. The outer periphery of the rubber seal 188 has a bead 194 that is trapped between the housing wall 144 and the exterior housing 180. The cavity 142 is hermetically sealed and is in fluid communication with the fluid inlet 12 so that when liquid is completely emptied out of the liquid source 11, the vacuum created at the liquid inlet 12 is communicated to the cavity 142.

The button 20 is seated within the exterior housing 180. The base 190 of the rubber seal 188 is seated on the button 20 so that the button 20 and the base 190 of the rubber seal 188 move in unison.

The pump 10 as shown in FIG. 2 may have at least four different housing components, namely, a first housing component 160, middle housing component 162 and second housing component 164. The middle housing component 162 may have a plurality of threaded holes 166 which receive bolts 168 which attach the first and second housing components 160, 164 to the middle housing component 162. Moreover, the junction 170*a, b* between the first and second housing components 160, 164 and the middle housing component 162 may receive an outer periphery (e.g., bead) of the flex barriers 108, 112 to provide a hermetic seal. The first piston 30 may be screwed on to the shaft 34 at the threaded connection 172. Bearings 175 may allow the shaft 34 to be traversed linearly and reciprocally within the first and second cylinders 26, 28. O-ring 177 seals the common wall 29 and shaft 34 so that liquid is not transferred between the first and second liquid chambers 38, 42. The pistons 30, 32 and the shaft 34 may be circular from the end view. Likewise, the interior surface of the cylinders 26, 28 may also have a matching cylindrical configuration to house the first and second pistons 30, 32. The second piston 32 may be fabricated as a unitary structure with the shaft 34. As shown, as the shaft 34 and pistons 30, 32 reciprocate in directions 45 and 47, the bearings 175 provide for smooth sliding or traversal of the shaft 34 and the O-ring 177 seals the first and second liquid chambers 38, 42. The housing 76 may additionally have a housing 72 for the manifold switching mechanism 44. The housing 72 has a cylindrical internal surface. The rings 48*a-d* and the O-ring 50 that make up the internal surface of the housing 72 may also be circular. The same is true for the spool 46, intermediate telescoping member 120 and the bolt 124.

Spring 130 has a serpentine configuration. Two serpentine springs 130, one on each side of the intermediate telescoping member 120 are engaged into the second housing component 164 and the intermediate telescoping member 120. The serpentine springs 130 are shown in FIGS. 5A and 10. Also, as shown in FIG. 10, the second piston 32 bumps up against the second housing component 164 at the end of the stroke in the direction of arrow 45. The intermediate telescoping member may have a groove 136 on opposed sides that receive and hold the distal end of the serpentine spring 130 (see FIG. 7). The opposed side of the serpentine spring 130 may be engaged into grooves 174*a, b* (see FIG. 6) or receptacles 174 formed in the second housing component 164. The grooves 174*a, b* define a plane 176. The medial ends of the springs 130 cross the plane 176 as the intermediate telescoping member 120 is being traversed in the direction of arrow 47 or in the direction of arrow 45 as discussed above. When the pistons 30, 32 and the shaft 34 are traversed in the direction of arrow 47, the groove 136 approaches the plane 176. The movement is caused by the compressed gas as discussed above. However, when the grooves 136 cross the plane 176, the springs 130 rapidly expand and shift the spool 46 in the direction of arrow 47 as discussed above under the power of the springs 130. Conversely, when the pistons 30, 32 and the shaft 34 are being traversed in the direction of arrow 45, the footing 132 of the flex barrier 112 contacts the base 134 of the intermediate telescoping member 120 to begin pushing the intermediate telescoping member 120 in the direction of arrow 45. The grooves 136 approach the plane 176 from the opposite side under the power of the compressed gas being filled into the first gas chamber 36. After the grooves 136 cross the plane 176, the springs 130 rapidly expand and push the telescoping member 120 and the spool 46 in the direction of arrow 45 as discussed above.

Referring now to FIG. 2, the spool 46 is held in the stationary position or trapped between the spring 130 and the flat end surface 80 of the housing 72 of the manifold switching mechanism 44. As compressed gas is introduced into the second gas chamber 40, the bolt 124 is traversed in the direction of arrow 47. The head 126 of the bolt 124 contacts the ledge 128 of the telescoping member 120 and pushes the telescoping member 120 in the direction of arrow 47 as well. This also traverses the groove 136 which holds the medial distal ends of the springs 130 across the plane 176. When the spring angle 150 (see FIG. 4) is at 4°, the ledge 121 of the telescoping member 120 is still not in contact with the lip 119 of the spool 46. At this point, the pistons 30, 32 are a distance 178 (i.e., 0.125 inch) away from the first housing component 160 and the common wall 29. When the spring angle 150 is at 5°, the ledge 121 of the telescoping member 120 contacts the lip 119 of the spool 46. When the groove 136 crosses over plane 176, the springs 130 expands rapidly and pushes the intermediate telescoping member 120 and the spool 46 in the direction of arrow 47 as shown in FIG. 5.

As discussed above, gas is introduced into the first gas chamber 36 and traverses the pistons 30, 32 and the shaft 34 in the direction of arrow 45. As the footing 132 of the flex barrier 112 contacts and pushes the intermediate telescoping member 120 in the direction of arrow 45, the groove 136 crosses over the plane 176. When the spring angle 151 (see FIG. 6) is at 4°, the springs 130 do not contact the spool 46, as shown in FIG. 7. At a spring angle 151 of 5°, the springs 130 contacts the spool 46 and begins to move the spool 46 in the direction of arrow 45 under the power of the springs 130. The springs 130 traverse the spool 46 in the direction of arrow 45 as shown in FIG. 9.

The first and second gas chambers 36, 40 are in gas communication with the gas inlet 16 and the gas outlet 17 through internal channels formed in one or more of the first, middle, second housing components 160, 162, 164 and the housing 72 of the manifold switching mechanism 44 and other parts of the pump 10 as needed. Moreover, the first and second liquid chambers 38, 42 are in fluid communication with liquid inlet and outlet 12, 14 through internal channels formed in one or more of the first, middle, second housing components 160, 162, 164 and the housing 72 of the manifold switching mechanism 44 and other parts of the pump 10 as needed. Although internal gas and liquid communications lines are depicted and discussed, it is also contemplated that external separate gas and liquid tubes may used to route the liquid and gas to the respective liquid inlet and outlet 12, 14 and the gas inlet and outlet 16, 17.

The above description is given by way of example, and not limitation. Given the above disclosure, one skilled in the art could devise variations that are within the scope and spirit of the invention disclosed herein, including various ways of Assembling the housing components 160, 162, 164 and 72. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A pressurized gas operated pump comprising:

a first cylinder;

a first piston linearly traversable within the first cylinder along a first axis;

a first flexible seal hermetically sealed to an interior surface of the first cylinder and the first piston to define a first liquid chamber and a first gas chamber within the first cylinder, the first liquid chamber and the first gas chamber being on opposed sides of the first piston and the first flexible seal;

a second cylinder;

a second piston linearly traversable within the second cylinder along the first axis;

a second flexible seal hermetically sealed to the interior surface of the second cylinder and the second piston to define a second liquid chamber and a second gas chamber, the second liquid chamber and the second gas chamber being on opposed sides of the second piston and the second flexible seal;

an elongate shaft linearly traversable along the first axis, the first and second pistons being fixedly attached to the elongate shaft;

a manifold for introducing gas into the first gas chamber while venting gas from the second gas chamber, and removing gas from the first gas chamber while introducing gas into the second gas chamber, the manifold, the second cylinder and the first cylinder being disposed adjacent to each other;

first and second gas channels routed from the manifold to the first and second gas chambers;

a shut off valve integrated into a housing of the pump to block fluid communication between the first gas chamber and the manifold by blocking gas flow only through the first gas channel and allowing gas flow through the second gas channel when the shut off valve is activated to prevent the pump from reaching an internal high load condition.

2. The pump of claim 1 wherein the first and second cylinders share a common dividing wall.

3. The pump of claim 1 further comprising first and second liquid inlet check valves in fluid communication with the first and second liquid chambers, the first and second liquid inlet check valves being oriented in a downstream direction.

4. The pump of claim 3 further comprising first and second liquid outlet check valves in fluid communication with the first and second liquid chambers, the first and second liquid outlet check valves being oriented in the downstream direction.

5. The pump of claim 1 wherein the shut off valve is a one way valve that allows gas to exhaust from the first gas chamber through the first gas channel when the shut off valve is activated so that the first and second gas chambers are depressurized when the pump is shut off to prevent the internal high load condition.

6. The pump of claim 1 wherein the shut off valve is a manual shut off valve having a twist to lock feature.

7. The pump of claim 5 wherein the shut off valve is activated when a vacuum exists at a liquid intake of the pump and due to the depressurization of the first and second gas chambers, the vacuum increases to further assure activation of the shut off valve.

8. The pump of claim 5 wherein the one way valve is a pin and seal having a mushroom configuration that allows gas to flow one way when the pin and seal are inserted into the first gas channel under pressure caused by a vacuum at a fluid inlet of the pump.

9. The pump of claim 8 wherein fluid communication is established between the fluid inlet and a cavity behind the pin and seal arrangement.

10. The pump of claim 8 wherein the pin and seal are biased so as to be not inserted into the first gas channel with a spring.

11. The pump of claim 1 further comprising a single spool valve having a spool linearly traversable between first and second positions within the manifold along the first axis, the spool aligned in the first position to introduce compressed gas into the first gas chamber and to remove gas from the second gas chamber, the spool aligned to the second position to remove gas from the first gas chamber and to introduce gas into the second gas chamber and being attached to the shaft.

12. The pump of claim 11 wherein the first piston, second piston and the spool share a common linear traversal axis.

13. The pump of claim 12 wherein the spool telescopes with respect to the shaft.

14. The pump of claim 13 further comprising an intermediate member wherein the shaft telescopes with respect to the intermediate member and the intermediate member telescopes with respect to the spool.

15. The pump of claim 11 wherein the spool defines one or more cavities which places the first and second gas chambers into fluid communication with an exhaust or a pressurized gas source depending on whether the spool is in the first or second positions.

16. The pump of claim 15 wherein the spool defines a first cavity and a second cavity, the first cavity of the spool being in fluid communication with the first gas chamber and a pressurized gas source, the second cavity of the spool being in fluid communication with the second gas chamber and an exhaust when the spool is in the first position.

17. The pump of claim 16 wherein the first cavity of the spool is in fluid communication with the first gas chamber and the exhaust and the second cavity is in fluid communication with the second gas chamber and the pressurized gas source when the spool is in the second position.

18. The pump of claim 11 wherein the spool valve is a three way spool valve.

19. A pressurized gas operated pump comprising:

a first cylinder;

a first piston linearly traversable within the first cylinder along a first axis;

a first flexible seal hermetically sealed to an interior surface of the first cylinder and the first piston to define a first liquid chamber and a first gas chamber within the first cylinder, the first liquid chamber and the first gas chamber being on opposed sides of the first piston and the first flexible seal;

a second cylinder;

a second piston linearly traversable within the second cylinder along the first axis;

a second flexible seal hermetically sealed to the interior surface of the second cylinder and the second piston to define a second liquid chamber and a second gas chamber, the second liquid chamber and the second gas chamber being on opposed sides of the second piston and the second flexible seal;

an elongate shaft linearly traversable along the first axis, the first and second pistons being fixedly attached to the elongate shaft;

a manifold for introducing gas into the first gas chamber while venting gas from the second gas chamber, and removing gas from the first gas chamber while introducing gas into the second gas chamber, the manifold, the second cylinder and the first cylinder being disposed adjacent to each other;

first and second gas channels routed from the manifold to the first and second gas chambers;

a shut off valve integrated into a housing of the pump to block fluid communication between the first gas chamber and the manifold by blocking gas flow through the first gas channel when the shut off valve is activated;

wherein the shut off valve is a one way valve that allows gas to exhaust from the first gas chamber through the first gas channel when the shut off valve is activated so that the first and second gas chambers are depressurized when the pump is shut off;

wherein the one way valve is a pin and seal having a mushroom configuration that allows gas to flow one way when the pin and seal are inserted into the first gas channel under pressure caused by a vacuum at a fluid inlet of the pump.

20. The pump of claim 19 wherein fluid communication is established between the fluid inlet and a cavity behind the pin and seal arrangement.

21. The pump of claim 19 wherein the pin and seal are biased so as to be not inserted into the first gas channel with a spring.

* * * * *